US006546222B2

(12) United States Patent
Sakemi et al.

(10) Patent No.: US 6,546,222 B2
(45) Date of Patent: Apr. 8, 2003

(54) DEVELOPING APPARATUS

(75) Inventors: Yuji Sakemi, Shizuoka (JP); Keiko Igarashi, Shizuoka (JP); Tomoyuki Sakamaki, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/874,000

(22) Filed: Jun. 6, 2001

(65) Prior Publication Data

US 2002/0028094 A1 Mar. 7, 2002

(30) Foreign Application Priority Data

Jun. 8, 2000 (JP) ..... 2000-172445
Jun. 26, 2000 (JP) ..... 2000-191336

(51) Int. Cl.[7] ..... G03G 15/08
(52) U.S. Cl. ..... 399/276
(58) Field of Search ..... 399/267, 276, 399/277

(56) References Cited

U.S. PATENT DOCUMENTS 5,946,536 A * 8/1999 Suzuki ..... 399/286
6,078,768 A * 6/2000 Suzuki ..... 399/257
6,201,942 B1 * 3/2001 Honda et al. ..... 399/286

FOREIGN PATENT DOCUMENTS

JP 9-68869 * 3/1997
JP 11-194605 * 7/1999

* cited by examiner

*Primary Examiner*—Quana M. Grainger
(74) *Attorney, Agent, or Firm*—Fitzpatrick, Cella, Harper & Scinto

(57) ABSTRACT

A developing apparatus for an image forming apparatus forms an electrostatic latent image corresponding to an image information signal on an image bearing member. The developing apparatus includes a developer carrying member which bears and conveys a two-component developer containing a non-magnetic toner and a magnetic carrier for forming a toner image by developing the electrostatic latent image formed on the image bearing member. Convexities and concavities are formed on a surface of the developer carrying member. An average peak-to-peak spacing (Sm) of the convexities and concavities is set at ⅓ to 6 times of a weight-average particle diameter of the magnetic carrier (D) ($D/3 \leqq Sm \leqq 6*D$). An average roughness at ten points (Rz) on the surface of the developer carrying member is set at 1/10 to ½ times of the weight-average particle diameter of the magnetic carrier. A number of concavities which are 1 μm to 10 μm wide and 0.2 μm or more deep is smaller than 10 within a spacing of 100 μm in a surface profile of the developer carrying member. The surface of the developer carrying member is prepared by blasting the surface with definite spherical particles having a weight-average diameter d and a weight-average particle diameter D of the magnetic carrier, according to the following relation:

$$D \leqq d \leqq 10D.$$

15 Claims, 5 Drawing Sheets

(PARTICLE DIAMETER : CARRIER > BLASTING MATERIAL)

(PARTICLE DIAMETER : CARRIER < BLASTING MATERIAL)

DEVELOPING APPARATUS

FIELD OF THE INVENTION AND RELATED BACKGROUND ART

The present invention relates to a developing apparatus to be used in image forming apparatuses such as a copier and laser beam printer which use electrophotographic systems and electrostatic recording systems for visualizing latent images formed on image bearing members by allowing toners in two-component developer to visualize the latent images. Specifically, the present invention relates to a developing apparatus which has an improved developer carrying member to be used for conveying a developer.

A developing apparatus to be used in an image forming apparatus such as a copier or a printer which uses an electrophotographic system for visualizing an electrostatic latent image formed on an image bearing member such as a photosensitive drum by allowing a toner in a developer to adhere to the latent image uses a developing sleeve (developer carrying member) such as a metallic developing sleeve bears a developer contained in a developer container on the developing sleeve, conveys the developer to a developing area opposed to the image bearing member and develops the electrostatic latent image formed on the image bearing member with the toner in the developer, thereby visualizing the latent image.

Used as the toner is a magnetic one-component toner consisting of a magnetic toner, non-magnetic one-component developer consisting of a non-magnetic toner or a two-component developer containing a non-magnetic toner and a magnetic carrier, and a material and a shape of the developing sleeve are selected dependently on the developer. In case of the two-component developer, a developing sleeve having magnetic field producing means such as a magnet provided therein is used, and a non-magnetic metal such as stainless steel or aluminium has conventionally been used mainly as a material of the developing sleeve.

In a developing apparatus such as that described above, a property to convey the two-component developer consisting of the non-magnetic toner (hereinafter referred to simply as "toner") and the magnetic carrier (hereinafter referred to simply as "carrier") to the developing area is enhanced by roughening a surface of the developing sleeve and a developer layer can be coated uniformly over the surface of the developing sleeve.

As a method to roughen the surface of the developing sleeve, there have been proposed and carried out a sandpaper method for rubbing the surface of the developing sleeve with sandpaper, a sand-blast method using particles having indeterminate forms, a mixture method combining these methods, a chemical etching method utilizing a chemical treatment and the like.

However, the conventional developing sleeve has problems which are described below.

When the developing sleeve which has a surface roughened by any one of the methods is used for a long time, the toner or a component of the toner tends to be caught and adhere in and to valleys (concavities) out of convexities and concavities on the roughened surface. When the developing sleeve is used for a long time, the toner adhering to the valleys tends to be fused by frictional heat generated by a pressed layer thickness regulating member which regulates a developer latent thickness on a sleeve surface layer and may contaminate the surface of the developing sleeve.

When the two-component developer containing the carrier is used, if there are the concavities and convexities on the surface of the developing sleeve, the toner or the component of the toner tends to be embedded into the valleys (narrow valleys in particular) by carrier's pressure. The toner embedded into the valleys fused to the developing sleeve, thereby tending to contaminate the surface of the developing sleeve after the developing sleeve is used for a long time.

In recent years where demands for color copiers and color printers have been enhanced, a particle size of a toner has been reduced and a softening point of the toner has been lowered to meet demands for higher qualities of images provided by copiers and printers as well as lower power consumptions, whereby the toner or a component in the toner has a higher tendency to be fused to the concavities and convexities on surfaces of developing sleeves which are roughened by the above described methods, resulting in contamination.

When the toner is fused to the surface of the developing sleeve, a developer is conveyed to a developing area in a smaller amount, thereby lowering an optical density of an image. Furthermore, it is conventional to apply a developing voltage of a DC voltage and/or an AC voltage to the developing sleeve for favorable development at a developing time, but when the toner is fused to the surface of the developing sleeve, a fused matter forms a high resistance layer on the surface of the developing sleeve, thereby hindering a desired electric field in the developing area between the developing sleeve and the image bearing body at a developing time.

An influence due to resistance enhanced by the contamination is remarkable in particular in a compact developing system which is adopted to form a high quality image using the two-component developer and capable of obtaining a sufficient optical density by reserving a distance of 1 mm or shorter between a developing sleeve and a photosensitive drum, and carrying out development while allowing a toner to fly from a surface of the developing sleeve using an electric field which is produced between the developing sleeve and the photosensitive drum by applying a DC voltage overlapped with an AC voltage. As a result, the enhanced resistance tends to make it impossible to obtain a sufficient developing effect of the developing bias voltage for the toner on a surface layer of the developing sleeve, thereby lowering an optical density or producing an image defect such as a white blank.

Actual image evaluations which were effected using a developing sleeve which was not contaminated, a developing sleeve which was contaminated and a developer provided a result that the contaminated developing sleeve lowered an optical density of an image 0.2 as compared with the developing sleeve which was not contaminated and produced an image defect such as the white blank. It will be understood from this result that contamination of a developing sleeve surface by a toner fused to the developing sleeve surface apparently constitutes a cause for lowering of an optical density and an image defect.

SUMMARY OF THE INVENTION

An object of the present invention is to solve the above described problem and provide a developing apparatus which prevents a toner from being embedded into a surface of a developer carrying member by a carrier when a two-component developer is used and free from contamination of the developer carrying member by a fused toner, thereby being making it possible to obtain good quality images stably for a long time.

An object of the present invention is to provide a developing apparatus for an image forming apparatus comprising means for forming an electrostatic latent image corresponding to image information on an image bearing member comprising:

a developer bearing body which bears and conveys a two-component developer containing a non-magnetic toner and a magnetic carrier to a developing area for forming a toner image by developing the electrostatic latent image on the above described image bearing member, wherein convexities and concavities are formed on a surface of the above described developer carrying member and an average peak-to-peak spacing (Sm) is set at ⅓ to 6 times of a weight-average particle diameter D of the above described magnetic carrier ($D/3 \leqq Sm \leqq 6*D$), wherein average roughness at ten points (Rz) on the surface of the above described developer carrying member is set at 1/10 to ½ times of a weight-average particle diameter (D) of the magnetic carrier and wherein concavities which are 1 μm to 10 μm wide by 0.2 μm or deeper exist in a number smaller than 10 within a spacing of 100 μm in a surface profile of the above described developer carrying member.

DETAILED DESCRIPTION OF THE INVENTION

This developing apparatus is capable of preventing a toner from being embedded into a surface of a developer carrying member by a carrier when a two-component developer is used, free from contamination of the developer carrying member by fused toner, thereby being capable of ensuring qualities of images stably for a long time and accomplishing the objects of the present invention.

The developing apparatus according to the present invention is a developing apparatus for an image forming apparatus which forms an image by developing an electrostatic latent image born on an image bearing member with a developer, which comprises a developer carrying member and prevents a toner from being born on the developer carrying member for a long time when a two-component developer containing a non-magnetic toner and a magnetic carrier is used, thereby being capable of preventing the toner from being fused to the developer carrying member and allowing the above described image forming apparatus to stably provide high quality images.

The above described developer carrying member functions to bear and convey the developer to a developing area for developing the electrostatic latent image on the image bearing member, and peaks and valleys are formed by concavities and convexities on a surface (bearing surface) of the developer carrying member. When a surface shape of the developer carrying member is expressed as a curve of the above described concavities and convexities in a section of the developer carrying member (this curve will hereinafter be referred to as "a sectional curve"), the above described "peak" denotes a portion which is protruding from an average line of a roughness curve of the sectional curve within a certain definite range (this line will hereinafter be referred to as "average line") and the above described "valley" denotes a portion which is concave from the average line. The average line of the roughness curve is defined by JIS B0601.

Figure 3:
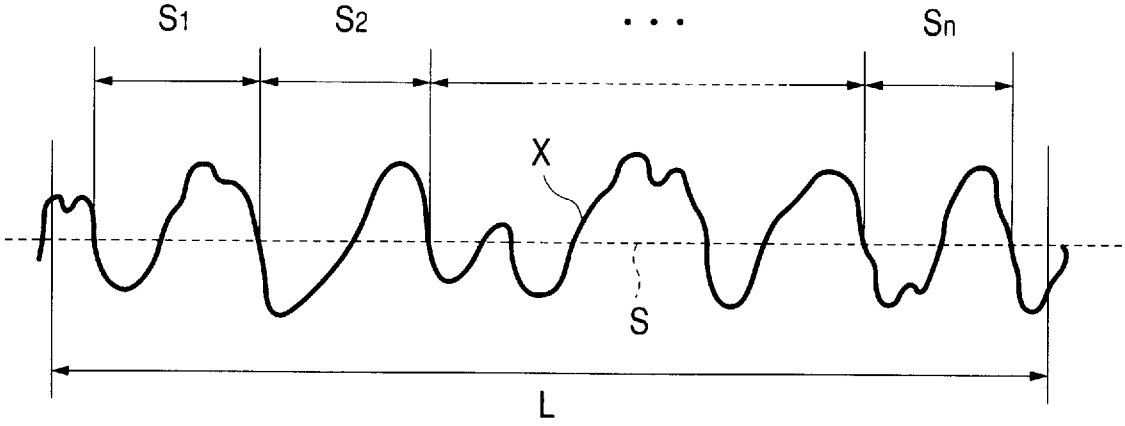
FIG. 3 is an enlarged view of a surface of a developing sleeve shown in FIG. 1 for description of an average peak-to-peak spacing.

Furthermore, the peak-to-peak spacing denotes a distance as measured from an intersection of an average line and a certain peak on a side of a valley to an intersection of the average line and another peak, which is adjacent to the certain peak with the valley interposed therebetween, on a side opposite to the valley as shown in FIG. 3, and an average peak-to-peak spacing denotes an average value of peak-to-peak spacings within a certain definite range.

Furthermore, concavities 1 μm to 10 μm wide by 0.2 μm or deeper (hereinafter referred to as fine concavities) may be formed on the surface of the developer carrying member. The above described fine concavities may be on peaks and in valleys so far as the concavities are within the above described range. The above described fine concavities refer to portions concave from a line provided by cutting convexities and filling fine concavities of the sectional curve in the above described sectional curve within a certain definite range, and a width of the fine concavity refers to a distance between intersections of the above described line and the sectional curve. A depth of the fine concavity refer to a distance from the above described line to a point where a line perpendicular to the above described line intersects with the sectional curve of the fine concavity.

The present invention prevents the toner from staying on the surface of the developer carrying member for a long time by increasing occasions of contact between the toner and the carrier on the surface of the developer carrying member, and preventing the toner from being embedded into the surface of the developer carrying member.

The occasions of contact between the toner and the carrier on the surface of the developer carrying member can be increased by setting the average peak-to-peak spacing (Sm) on the surface of the developer carrying member and the average roughness at ten points (R) within predetermined ranges. The embedding of the toner into the surface of the developer carrying member can be prevented by allowing the above described fine concavities to exist in a number smaller than 10 within a spacing of 100 μm in a profile of the surface of the developer carrying member.

Next, a description will be made of each factor.

The above described average peak-to-peak spacing (Sm) qualitatively expresses a spacing from a certain peak to an adjacent peak. Generally speaking, a larger average peak-to-peak spacing enhances a contacting property between the toner and the carrier on the surface of the developer carrying member. For the present invention, an average peak-to-peak spacing which is ⅓ to 6 times of the weight-average particle diameter (D) of the magnetic carrier ($D/3 \leqq Sm \leqq 6*D$) is preferable or $D/2 \leqq Sm \leqq 3*D$ is more preferable. When the average peak-to-peak spacing is too much narrower than the above described range, the contacting property between the toner and the carrier is lowered, thereby making it impossible to sufficiently prevent the toner from being fused. When the average peak-to-peak spacing is too much wider than the above described range, a developer conveying property of the developer carrying member is lowered.

The above described average roughness at ten points (Rz) qualitatively expresses a difference in height between a peak and a valley of the convexities and concavities. Generally speaking, lower average roughness at ten points enhances the contacting property between the toner and carrier on the surface of the developer carrying member. For the present invention, average roughness at ten point which is 1/10 to ½ times of the weight-average particle diameter (D) of the magnetic carrier is preferable. When average roughness at ten points is too much narrower than the above described range, a catching function of the developer carrying member is lowered, thereby lowering the developer conveying property. When average roughness at ten points is too much larger than the above described range, in contrast, the convexities and concavities are large enough for visual confirmation, thereby tending to make obtained images ununiform and produce influences on image qualities.

The above described fine concavity expresses a concavity into which the toner tends to enter or be caught. Generally speaking, the toner which has penetrated or been caught in the fine concavities can hardly be brought into contact with the carrier and leave from the fine concavities since the fine concavities are smaller than the carrier. For the present invention, it is preferable that the fine concavities do not exist in a number of 10 or larger in a spacing of 100 μm in the profile of the surface of the developer carrying member. When the fine concavities exist in a number of 10 or larger in the above described spacing, the toner which exists on the surface of the developer carrying member for a long time is fused at high frequencies, whereby images may be defective due to contamination of the surface of the developer carrying member.

It was found that average roughness at ten points Rz within a range of $D/6 \leqq Rz \leqq D/2$ is more preferable for preventing the developing sleeve from being contaminated and enhancing the developer conveying property, taking the average particle diameter of the carrier as D. In a case where average roughness at ten points Rz on the surface of the developing sleeve is D/6 or higher, the carrier is sufficiently caught by the concavities and convexities of the surface of the developing sleeve and frictional resistance is enhanced between the developer and the developing sleeve, whereby the developer conveying property can be made higher. When average roughness Rz at ten points exceeds D/2, however, edges corresponding to the convexities out of the concavities and convexities in the surface of developing sleeve becomes remarkably sharp, produce influences on formation of carrier ears and result in influences on images. Furthermore, it is remarkably difficult to manufacture a developing sleeve which has such surface roughness. When average roughness at ten points Rz is adjusted as described above, the conveying property is enhanced without aggravating contamination of the developing sleeve surface with the toner.

Then, description will be made of a reason for enhancement of the conveying property which is obtained in a case where the developing sleeve is blasted with coarser particles (having a smaller mesh number). Comparing a developing sleeve A blasted with definite glass beads of #400 mesh (FGB#400) with a developing sleeve B blasted with definite glass beads of #300 mesh (FGB#300) (both the developing sleeves made of aluminium), the developing sleeve B which was blasted with the definite glass beads of #300 mesh exhibited an enhanced conveying property. The #400 mesh and the #300 mesh used for classification are standard sieves having square meshes which are specified by JIS Z 8810 as grain size measuring sieves: the #400 mesh corresponding to 37 μm and the #300 mesh corresponding to 50 μm. A magnetic carrier having an average particle diameter of 40 μm was used. The developing sleeve A was blasted with spherical glass beads having a diameter smaller than that of the magnetic carrier, whereas the developing sleeve B was blasted with spherical glass beads having a diameter larger than that of the magnetic carrier.

Figure 8:
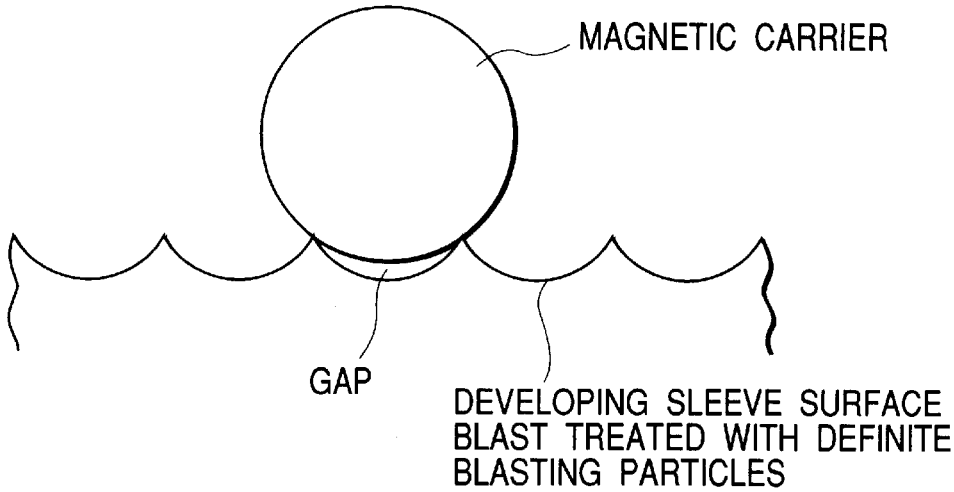
FIG. 8 is an enlarged view of the surface of the developing sleeve shown in FIG. 1 for description of an embodiment of the present invention.

Comparing a manner of the magnetic carrier on the developing sleeve A with a manner of the magnetic carrier on the developing sleeve B, the magnetic carrier cannot penetrate into a depth of a spherical groove and a gaps is formed between the magnetic carrier and the spherical groove on the developing sleeve which was blasted with the spherical beads having the diameter smaller than that of the carrier as shown in FIG. 8. Accordingly, the magnetic carrier cannot be caught firmly in the spherical groove and tends to roll over the groove on the developing sleeve. Frictional resistance between the developer and the developing sleeve is therefore lowered and a conveying force of the developing sleeve is weakened. When the developing sleeve was blast treated with the spherical beads having the diameter larger than that of the magnetic carrier, on the other hand, the magnetic carrier can penetrate into a depth of a spherical groove and no gap is formed between the magnetic carrier and the spherical groove on the developing sleeve. Accordingly, the magnetic carrier can be caught firmly in the spherical groove and hardly roll on the developing sleeve. It is therefore considered that frictional resistance between the developer and the developing sleeve is enhanced and a conveying property of the developing sleeve is enhanced.

Figure 9:
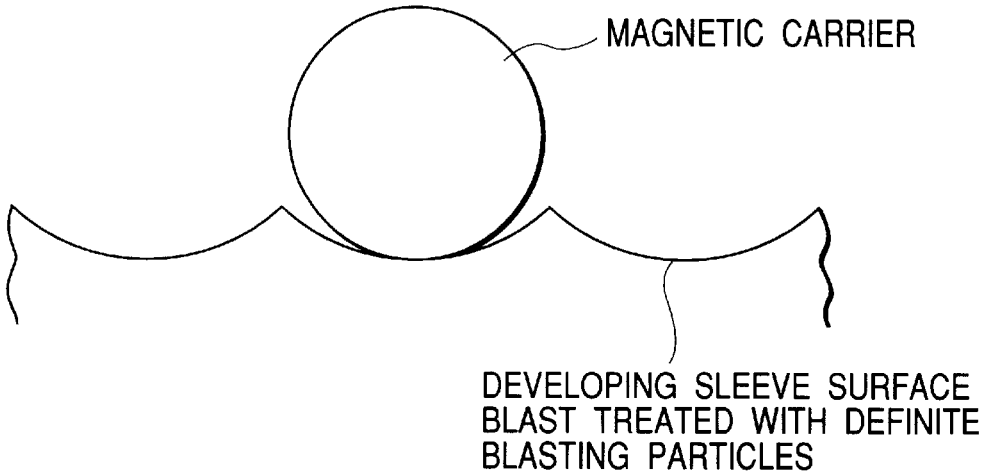
FIG. 9 an enlarged view of the surface of the developing sleeve shown in FIG. 1 for description of an embodiment of the present invention.

A developer conveying property of a developing sleeve is enhanced when a surface of the developing sleeve is blast treated with spherical beads having a diameter larger than that of a magnetic carrier. However, it will be understood that blast treatment of a surface of a developing sleeve with spherical beads having a diameter larger than the magnetic carrier provides not only enhancement of the developer conveying property but also another merit related to contamination of the developing sleeve. It is considered that this merit is obtained for a reason described below. When the surface of the developing sleeve is blast treated with the spherical beads having the diameter smaller than that of the magnetic carrier, the magnetic carrier cannot penetrate into a bottom of the spherical groove as shown in FIG. 8 and a gap is formed between the magnetic carrier and the spherical groove on the developing sleeve as shown in FIG. 8. Since the toner which has penetrated into this gap cannot be scratched off with the magnetic carrier, the toner tends to be stagnant and stay. As a result, this residual toner accumulates heat and is fused. When the surface of the developing sleeve is blasted with the spherical glass beads having the diameter larger than that of the magnetic carrier, on the other hand, the magnetic carrier can penetrate into the bottom of the gap on the developing sleeve, whereby no gap is formed between the magnetic carrier and the spherical groove on the developing sleeve as shown in FIG. 9. Accordingly, the toner adheres to the carrier and is conveyed at a circulating process of the carrier without staying on the surface of the developing sleeve. As a result, the toner is not apt to contaminate the developing sleeve.

As a result of detailed examinations of kinds of carriers and the like, it was found that a blast treatment with definite spherical particles having an average diameter d which is not smaller than the weight-average particle diameter D of a magnetic carrier and not larger than 10D ($D \leqq d \leqq 10D$) is more effective for preventing the contamination of the developing sleeve and enhancing the developer conveying property. When the diameter d of the definite spherical particles is not smaller than the weight-average particle diameter D of the magnetic carrier, the frictional resistance is increased between the developer and the developing sleeve, the developer conveying property is enhanced and the contamination of the developing sleeve is reduced as described above. However, the carrier forms ears in the developing area at intervals of about 10 times of a carrier diameter so as to form magnetic brushes when a magnetic ferrite carrier is used though a distance between the ears is different dependently on magnetic forces, diameters of carriers or magnetization of the carriers. When a diameter of the definite particles exceeds 10 times of the carrier diameter, ears of the magnetic brushes are at random and a layer of the developer tends to be ununiform under an influence due to concavities and convexities of the ears. The conveying property of the surface of the developing sleeve is enhanced and the contamination of the developing sleeve is reduced by adjusting the average diameter d of the definite spherical particles to be used for the blast treatment of a surface of a developing sleeve.

Examinations effected by the inventor et al. clarified that the contamination of a surface of a developing sleeve by a toner is not aggravated, the developer conveying property is enhanced and a developing sleeve conveys a developer in a stable amount to a developing area, thereby stabilizing an image quality for a long time (1) when the average roughness at ten points Rz is within a range of $D/6 \leqq Rz \leqq D/2$ taking an average particle diameter of a carrier as D and (2) when a developing sleeve is blast treated with definite spherical particles having the average diameter d which is not smaller than the average particle diameter D of a magnetic carrier and not larger than 10D ($D \leqq d \leqq 10D$).

The above described average peak-to-peak spacing, average roughness at ten points and fine concavities can be measured by any method or with any measuring instrument so far as the method or the instrument has a measuring limit permitting measuring at least the fine concavities, and the measuring method is not limited specifically or may be a conventionally known surface roughness measuring method. Such a measuring method may be, for example, a measuring method using a contact type surface roughness meter (Surf coder SE-3300 manufactured by Kosaka Research Institute, Co., Ltd.) or a method which measures by analyzing electron micrograph of a vicinity of a surface in a section of a developer carrying member.

A developer carrying member which meets at least the above described three factors assures a favorable contact property between a toner and a carrier as well as prevention of toner fusing on a surface of the developer carrying member. Such a developer carrying member can be prepared by carrying out a surface roughening treatment of an original member (a developer carrying member having a surface not roughened). It is preferable that the surface roughening treatment is carried out in appropriate conditions matched with a material of the developer carrying member and a treating method so as to meet the above described factors.

The surface treating method may be, for example, the above described sandpaper method, sand-blast method, chemical edging method and a mixture method which combines two or more of these methods. The present invention makes it possible to carry out the surface roughening treatment by these method and similar methods. It is preferable for the present invention to adopt a blast method.

It is proper to select a blasting material for the blast method dependently on physical properties of a material of a developer carrying member and usable as the blasting material are, for example, silica sand, river sand, cast iron grid, cast steel grid, cut wires, alumina grid, silicon carbide grid, slug grid and glass beads. In order to prevent the above described fine concavities from being formed, it is preferable to use a blasting material which has a relatively small particle diameter and a definite form arranged nearly spherical.

Though a developer carrying member is not limited in particular in its form so far as the developer carrying member is capable of supplying a toner to an image bearing member, it is preferable that the developer carrying member is made of a material which is non-magnetic and electrically conductive. Such a material may preferably be, for example, stainless steel and aluminium. For a reason of working facility, it is preferable to select aluminium when a developer carrying member made of a material exemplified above is to be subjected to the surface roughening treatment by the above described blast method.

When a developer carrying member is made of aluminium excellent in a workability, however, the developer carrying member has low abrasion resistance. For the present invention, it is therefore more preferable to form a layer having sufficient hardness on a surface of a developer carrying member.

For example, glass beads are prepared as definite blasting particles and the blasting treatment is carried out. A method for the blasting treatment is to blast the glass beads under an air pressure (blasting pressure) of 3 $kg/cm^2$ from a nozzle to a surface of a developing sleeve rotating at 12 rpm from a blast nozzle which is apart for a distance of 10 mm from the developing sleeve and has a diameter of 7 mm while moving the blast nozzle in parallel with an axis of the developing sleeve. The surface of the developing sleeve is roughened by the above described blast treatment of the developing sleeve.

After the blast treatment, the surface of the developing sleeve is washed and dried. Conditions such as the rotating speed, the distance from the blast nozzle to the developing sleeve, and the like are slightly modified dependently on a material of an original pipe of the developing sleeve and the like. Blast conditions are not limited to those mentioned above. Though the glass beads are used as definite blasting particles, the definite blasting particles are not limited to the glass beads, and stainless steel balls, ceramic balls, steel balls and ferrite balls or the like, for example, may be used as definite blasting particles. However, the steel balls and ferrite balls are magnetic materials and not suited to blasting with a permanent magnet member built in a developing sleeve.

The above described layer is not limited in particular so far as the layer has hardness sufficient to compensate for abrasion resistance of the developer carrying member, and is non-magnetic and electrically conductive. Mentionable as such a layer is, for example, a metal plating of a metal of simple substance or a metal containing another element such as Ni—P, Ni—B or Cr, or an alloy or a resin layer containing internally dispersed crystalline graphite or electrically conductive carbon. This layer is to be used selectively dependently on materials to be used and can be formed by a normal method. A resin to be used in the above described resin layer is satisfactory so far as the resin has a sufficient physical property of hardness and a phenol resin can be mentioned as an example. The plating includes electroless plating. The electroless plating may be, for example, electroless Ni—P plating, electroless Ni—B plating, electroless Pd—P plating or electroless Cr plating which is not limitative. The electroless plating has a merit that it provides a uniform plating thickness and is capable of maintaining roundness produced by collision with a spherical particle as compared with another plating, for example, electrolytic Ni plating which tends to allow plating to adhere to an edge portion, thereby making a plating thickness ununiform. Furthermore, the electroless plating has another merit that it has strong throwing power, brings a plating material even to a bottom of a deep hole and forms no concavity or convexity on a surface, thereby forming a smoother surface. Accordingly, the electroless plating makes it possible to efface fine notches on a blasted surface and obtain a smooth surface free from microscopic concavities and convexities while maintaining a surface shape after blasted with definite spherical particles. When plating is too thick, however, a surface may be too smooth, thereby degrading a conveying property of the developing sleeve. Accordingly, it is preferable that a plating thickness is 20 $\mu$m or smaller which is a range within which a shape formed by collision with a spherical particle is maintained at a certain degree.

In addition, magnetic field producing means is provided in the developer carrying member, and in order to uniformly bear the developer, which is contained in the developing apparatus and newly supplied to the developer carrying member, on the surface of the developer carrying member, the magnetic field producing means preferably comprises a first magnetic pole provided downwardly from the developing area in the direction of the developer conveying direction and a second magnetic pole provided downwardly from the first magnetic pole in the developer conveying direction and having the same polarity as the first magnetic pole.

Furthermore, in order to uniformly bear the new developer on the surface of the developer carrying member, it is preferable that a repulsive pole for substantially canceling the magnetic forces generated by the first and second magnetic poles is provided between these magnetic poles to allow the developer returning from the developing area to readily leave the surface of the developer carrying member.

The magnetic field producing means is not limited on particular so far as the means generates a force which is sufficient for at least bearing the magnetic carrier on the developer carrying member. The magnetic field producing means may be means which forms a magnetic field permanently like a so-called magnet or means which can form a magnetic field intermittently or optionally like an electromagnet. Furthermore, it is preferable that the magnetic field producing means is set at a magnetic pole appropriate for bearing or discharging the developer.

The first magnetic pole and second magnetic pole are either N poles or S poles for bearing the developer. More detailedly, the first magnetic pole is a magnetic pole for bearing the developer returning from the developing area and the second magnetic pole is a magnetic pole for bearing new developer supplied from the developing apparatus. These first and second magnetic poles may have magnetic forces identical to each other or different from each other so far as the magnetic poles have an identical polarity.

The repulsive pole functions to cancel a magnetic force to a degree at which the magnetic carrier is released from bearing by the first magnetic pole and the second magnetic pole while the magnetic carrier is conveyed from the first magnetic pole to the second magnetic pole, and may intercept influences due to both the magnetic poles between the first magnetic pole and the second magnetic pole or cancel the influences due to the two magnetic poles with each other.

The developing apparatus according to the present invention may be disposed relative to the image bearing member so that the developer is brought into contact with the image bearing member for developing the electrostatic latent image or so that the electrostatic latent image is developed without bringing the developer into contact with the image bearing member. For enhancing a developing efficiency, it is preferable to equip the developing apparatus with electric field producing means for producing an alternating electric field between the image bearing member and the developer carrying member. Conventionally known means can be used as the electric field producing means. A power source which applies a voltage to the developer carrying member can be mentioned as an example of the electric field producing means and a voltage containing an alternating voltage may be applied.

The developer used for the developing apparatus according to the present invention is a two-component developer which contains a non-magnetic toner and a magnetic carrier. It is possible to use conventionally known non-magnetic toners and magnetic carriers, manufacturing and measurements of particle diameters of which can be carried out by normal methods. It is preferable to set mixing ratios between the non-magnetic toners and magnetic carriers dependently on kinds and physical properties of the used toners and carriers as well as demanded image qualities.

For obtaining a high quality image, it is preferable that the non-magnetic toner has a weight-average particle diameter of 5 to 9 $\mu$m. Furthermore, for preventing the toner from penetrating into the above described fine concavities, it is preferable that the non-magnetic toner is uniform in a particle size and a form and it is preferable in particular that the non-magnetic toner has a spherical form. It is preferable that the non-magnetic toner is a polymerized toner which is manufactured, for example, by an emulsion polymerization method or a suspension polymerization method. Furthermore, the toner can be adjusted to a desired particle size and a desired particle size distribution by classifying the toner, and selecting or mixing toners of proper particle sizes.

The magnetic carrier is not limited in particular so far as the magnetic carrier can bear the non-magnetic toner. For bearing the above described non-magnetic toner, it is preferable that the magnetic carrier has a weight-average particle size of 20 to 60 $\mu$m. Furthermore, the magnetic carrier may have a surface which has been treated for hydrophobic property.

The developer may contain other particles in addition to the non-magnetic toner and the magnetic carrier. Such particles may be, for example, particles for controlling or aiding a charged characteristic of the non-magnetic toner and particles for enhancing fluidity of the non-magnetic toner or the magnetic carrier.

Furthermore, the developing apparatus according to the present invention can be equipped with the above described developer carrying member which is not limitative in particular and conventionally known other components. These components may be, for example, a developer container for containing the developer, agitating means for agitating the developer in the developer container, a toner replenisher for replenishing the non-magnetic toner to be consumed and a developer regulating member for regulating an amount of the developer to be borne on the surface of the developer carrying member.

An image forming apparatus to be used by the present invention is not limited in particular so far as the image forming apparatus comprises means for forming an electrostatic latent image corresponding to an image information signal and the above described developing apparatus according to the present invention. Accordingly the image forming apparatus is capable of comprising various conventionally known components.

The above described image forming apparatus may adopt an image forming system for visualizing an electrostatic latent image with a developer and such an image forming system is, for example, an electrophographic system which forms an electrostatic latent image on a photosensitive drum, forms a toner image by developing the electrostatic latent image, transfers the toner image to a recording material by way of an intermediate member or not by way of an intermediate member and forms an image by fixing the toner image or an electrostatic recording system which forms and develops an electrostatic latent image on a recording material, and forms an image by fixing this image. Any image bearing member may be used so long as it bears the electrostatic latent image, whether or not an image is fixed on the image bearing member.

First Embodiment

Now, description will be made of embodiments of the developing apparatus according to the present invention with reference to the accompanying drawings. The developing apparatus is used, for example, in an image forming apparatus which is described below, but the present invention is not limited by the embodiments.

Figure 1:
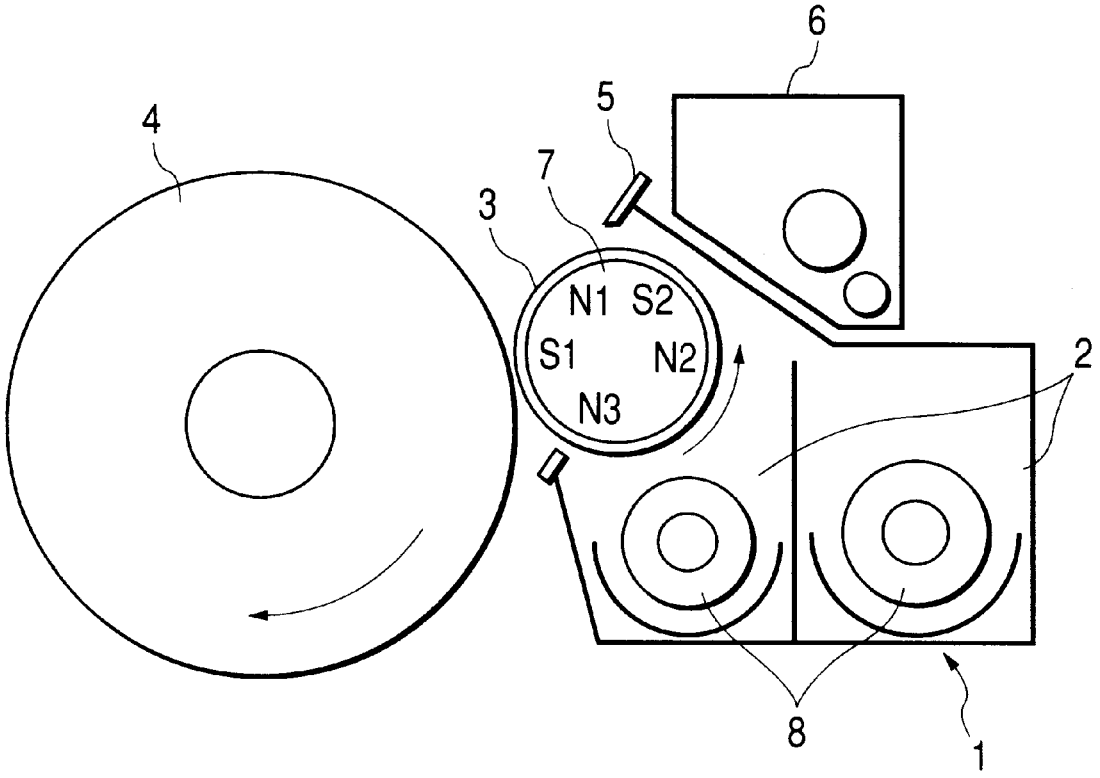
FIG. 1 is a schematic diagram descriptive of a developing apparatus according to an embodiment of the present invention.
Figure 2:
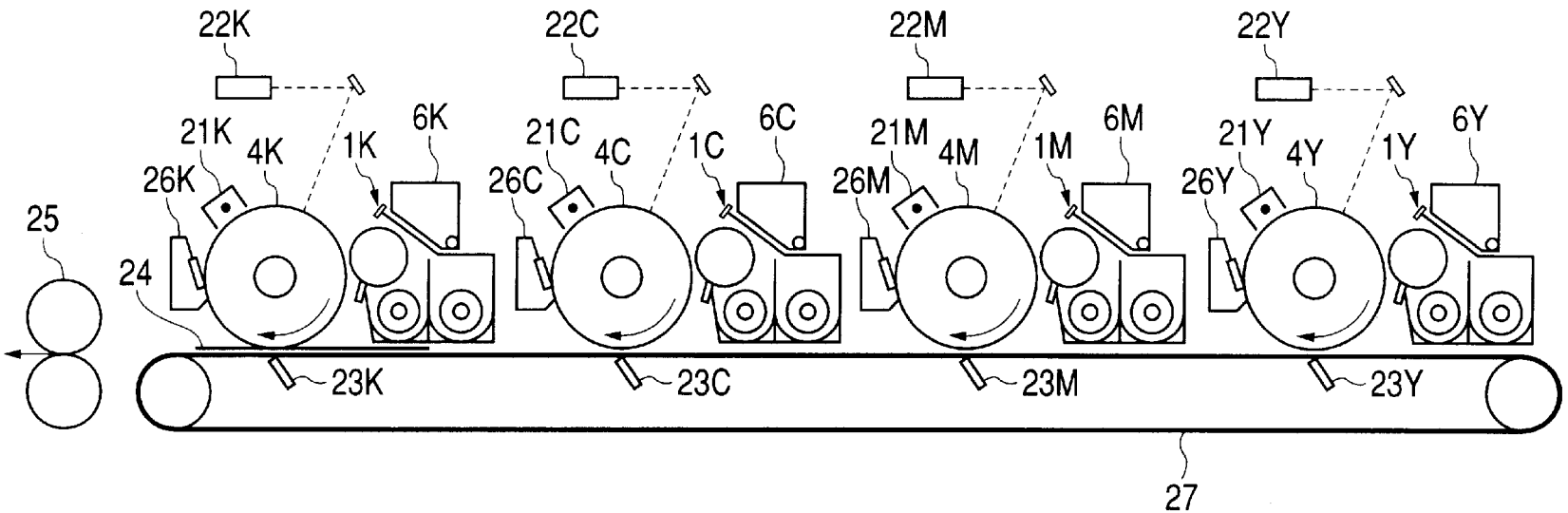
FIG. 2 is a schematic diagram descriptive of an image forming, apparatus using the developing apparatus according to the embodiment of the present invention.

FIG. 1 is an enlarged view of stations of Y, M, C and K in a full color image forming apparatus shown in FIG. 2. Stations Y, M, C and K have configurations which are nearly identical, and form yellow (Y), magenta (M), cyan (C) and black (K) toner images respectively on a full color image. In description that follows, a developing apparatus 1, for example, denotes a developing apparatus 1Y, a developing apparatus 1M, a developing apparatus 1C and a developing apparatus 1K commonly at each station Y, M, C, and K.

A description will now be made of a configuration of the image forming apparatus as a whole.

The image forming apparatus is an electrophotographic type image forming apparatus which comprises a photosensitive drum 4 functioning as an image bearing member, a primary charger 21 for charging the photosensitive drum 4, a light emitting element 22 for forming an electrostatic latent image on a surface of the charged photosensitive drum 4, a developing apparatus 1 for forming a toner image by feeding a developer to the photosensitive drum 4 on which the electrostatic latent image is formed and developing the electrostatic latent image, a transferring charger 23 for transferring the toner image from the photosensitive drum 4 to transferring paper 24 by way of an intermediate member or not by way of an intermediate member, a transferring paper conveying sheet 27 for conveying the transferring paper 24 bearing the unfixed toner image to a next step, a fixing apparatus 25 for fixing the unfixed toner image on the transferring paper 24 and a cleaning device 26 for removing residual toner from the photosensitive drum 4 after transferring.

Next, a description will be made of operations of the image forming apparatus as a whole with reference to FIG. 2.

The photosensitive drum 4 is rotatably disposed as the image bearing member, and an electrostatic latent image is formed by uniformly charging the photosensitive drum 4 with the primary charger 21 and exposing the photosensitive drum 4 with light modulated according to an information signal by the light emitting element 22 such as a laser. The electrostatic latent image is visualized as a toner image by the developing apparatus 1 at a process described later. Then, the toner image is transferred by the transferring charger 23 to the transferring paper 24 transferred by the transferring paper conveying sheet 27 and fixed by the fixing apparatus 25, thereby obtaining a permanent image. Residual toner remaining on the photosensitive drum 4 after transferring is removed by the cleaning device 26.

Next, a description will be made of a configuration of the developing apparatus 1.

The developing apparatus 1 is disposed in opposition to the photosensitive drum 4 as shown in FIG. 1, and comprises a developer container 2 for containing a developer, a developing sleeve 3 for bearing the developer contained in the developer container 2 and conveys the developer to the photosensitive drum 4, a blade 5 functioning as a ear height regulating member for regulating an amount of the developer born on the developing sleeve 3 and a toner replenishing tank 6 for replenishing the developer container 2 with a toner contained in the developer. Connected to the developing sleeve 3 and the photosensitive drum 4 is a developing bias power source (not shown) as electric field producing means.

The developer container 2 is divided by a partition wall into two spaces in each of which an agitating screw 8 is disposed. Contained in both the two spaces is a two-component developer containing a non-magnetic toner and a magnetic carrier. A magnet 7 is fixed in the developing sleeve 3 as magnetic field producing means. Furthermore, formed in the vicinity of an opening of the developer container 2 is a developer reservoir portion 10 which is surrounded by the developing sleeve 3, the blade 5 and the developer container 2.

Next, a description will be made of the operations of the developing apparatus 1 with reference to FIG. 1.

The developer container 2 is open toward the photosensitive drum 4 and the developing sleeve 3 is rotatably disposed in this opening so as to be partially exposed. The developing sleeve 3 is made of a non-magnetic material, has convexities and concavities formed on its surface, forms a developing area between the photosensitive drum 4 and the developing sleeve 3, and rotates at a developing time in a direction indicated by an arrow in FIG. 1. The developing sleeve 3 which contains the magnet 7 bears and conveys a layer of the two-component developer having a thickness regulated by the blade 5 from the developer reservoir portion 10 to the developing area and the toner develops the electrostatic latent image formed on the photosensitive drum 4 in the developing area when the developer is fed to the photosensitive drum 4. The toner is replenished in an amount corresponding to that of the toner consumed by image formation from the toner replenishing tank 6.

The magnet 7 consists of five poles and the developer which is agitated by the agitating screws 8 is restrained on the developing sleeve 3 with a magnetic force of a conveying pole (drawing up pole) N2 for drawing up the developer, forms a layer of the developer with functions of a regulating magnetic pole (S2) and the blade 5, and is covered while forming magnetic brushes. Then, the developer is conveyed to the developing area by a magnetic force of a conveying magnetic pole N1 and a rotation of the developing sleeve 3. Then, the toner is fed to the photosensitive drum 4 in the developing area opposed to the photosensitive drum 4 with functions of a magnetic pole S1 and the electric field of the above described developing bias power source, and develops the electrostatic latent image formed on the photosensitive drum 4.

After developing the electrostatic latent image on the photosensitive drum 4 in the developing area, the developer is conveyed from the developing area into the developer container 2 by a magnetic force of an intake magnetic pole N3 and the rotation of the developing sleeve 3. The intake magnetic pole N3 and the drawing up magnetic pole N2 have an identical polarity, and disposed between these two magnetic poles is an area in which a magnetic force is nearly 0 Gauss (repulsive pole not shown). Accordingly, the developer after developing the electrostatic latent image is accommodated into the developer container 2 without being drawn up successively and restrained by the drawing up magnetic pole N2.

In case of a configuration in which a repulsive pole is disposed as in the first embodiment, the repulsive pole reduces free running of the developer, and hardly allows the toner to adhere and stay to and on a surface of the developing sleeve 3, thereby exhibiting an effect to reduce fusion of the toner to the sleeve. Accordingly, it is effective for reducing contamination of the developing sleeve 3 to use a combination of the magnet 7 having the repulsive pole and the developing sleeve 3 having a surface configuration which is described below as in the first embodiment.

Characteristic points of the first embodiment will now be described in more detail.

In the first embodiment, the developing sleeve 3 is made of the non-magnetic material, and the convexities and concavities are formed on the surface of the developing sleeve 3 to impart a force for conveying the developer. As described with reference to the conventional example, however, a toner or a component in the toner tends to adhere and be fused to convex and concave portions of a roughened surface and the surface may be contaminated dependently on a condition of a roughened surface when a developing sleeve has a roughened surface.

Several developing sleeves were manufactured using stainless steel and aluminium as materials of the developing sleeves, surfaces of the developing sleeve were roughened by blasting the surfaces using indefinite alumina particles (ARD) and spherical glass bead particles (FGB) as abrasive grains, and surface roughness was measured.

Used for measurements of the surface roughness was a contact type surface roughness meter (Surf Coder SE-3300 manufactured by Kosaka Research Institute, Co., Ltd.). This measuring instrument is capable of measuring the average roughness at ten points Rz and the average peak-to-peak spacing Sm between convexities and concavities at the same time. Two measuring conditions were used, that is, a standard mode and a detail mode. Measuring conditions in the standard mode were a cutoff value of 0.8 mm, a measuring length of 2.5 mm, a feeding speed of 0.1 mm/sec, a height magnification of 5000× and a lateral magnification of 50×, whereas measuring conditions in the detail mode were a cutoff value of 0.08 mm, a measuring length of 0.25 mm, a feeding speed of 0.05 mm/sec, a height magnification of 5000× and a lateral magnification of 5000×.

Rz denotes average roughness at ten points specified by JIS B0601 and qualitatively denotes a difference in height between a peak and a valley of a convexity and a concavity. Furthermore, Sm denotes in FIG. 3 an arithmetical mean of a spacing S1 between a first cross point from a peak to a valley crossing an average line of a sectional curve in a section of a standard length (measuring length) L cut out of a sectional curve X of a roughened surface and subsequent spacings S2, S3, . . . , Sn (n denotes a total number of cross points in the standard length) which is expressed by the following formula.

$$Sm=(S1+S2+\ldots+Sn)/n$$

Qualitatively, Sm denotes an average spacing between a peak and an adjacent peak. Measured values which were obtained in the standard mode are used as data of Rz and Sm.

Measuring conditions in the detail mode were used as conditions for confirming an existing amount of concavities which had curvature largely different from curvature of a curve forming peaks and valleys in the profile of the surface and sizes 1 μm to 10 μm wide by 0.2 μm or deeper.

This surface roughness was compared with a contamination degree of the developing sleeve after a long period of use corresponding to 10000 sheets. At this time, examinations were made using a two-component developer (TC=8/92) consisting of a non-magnetic toner having a weight-average particle diameter of 8 μm and a magnetic carrier having a weight-average particle diameter of 40 μm. For evaluating a contamination concentration, rays reflected from the surface was measured with a reflection type densitometer before and after use, and a difference between optical densities ΔD was adopted as an optical density.

Figure 4:
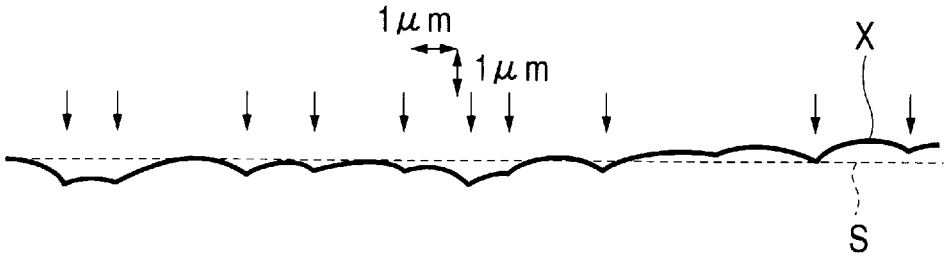
FIG. 4 is an enlarged view of a surface of a developing sleeve in example 1 for description of an average peak-to-peak spacing.

As experimental example 1 (comparative example 1), a developing sleeve made of stainless steel was blasted using indefinite alumina particles (ARD#400), thereby roughening a surface. A surface condition of this developing sleeve exhibited Rz=3 μm and Sm=13 μm. A surface profile of this developing sleeve is shown in FIG. 4. When a surface was roughened with ARD#400, a curve forming peaks and valleys was not clear and concavities 2 μm to 10 μm wide by 0.2 μm or deeper (indicated by ↓ in FIG. 4) existed everywhere on a surface in a number of about 30 within a spacing of 100 μm as shown in FIG. 4.

When such a developing sleeve was used, the toner was fused to the surface of the sleeve as shown in Table 1 after the developing sleeve was used for a long time to develop images on 10000 sheets. Speaking of a conveying property of this case, the surface of the developing sleeve has small Rz but a high coefficient of friction owing to the blasting with the indefinite alumina particles and improper developer conveyance was not confirmed as a result. The inventor et al. considered that a toner fusing phenomenon took place for a cause which is described below.

In a two-component development system such as that used in the example, a developing sleeve 3 conveys to a developing area a magnetic carrier to which a toner adheres while holding the carrier on a surface of the developing sleeve. Furthermore, toner particles having diameters of 2 μm and smaller are increased when a particle diameter of a toner is reduced. It is considered that the toner particles having such particle diameters tend to sink into concavities 1 μm to 10 μm wide by 0.2 μm or deeper, and adhere and stay to and on a surface of the sleeve.

When the average peak-to-peak spacing Sm on a surface of a developing sleeve is much smaller than a weight-average particle diameter of a magnetic carrier as in the experimental example 1 (comparative example 1) in particular, a carrier cannot penetrate into fine concavities even if a toner penetrates into such fine concavities under pressure of the carrier. As a result, it is considered that the toner has no occasion to be brought into contact with the carrier at a circulating process of the carrier, adheres in a condition caught in the concavities on the surface of the sleeve and is fused during long use.

The inventor et al. considered that the average peak-to-peak spacing Sm which is much smaller than a weight-average particle diameter of a magnetic carrier was a cause for toner fusion to a sleeve surface, and blasted a developing sleeve made of aluminium with indefinite alumina particles (ARD#150) having a particle diameter larger than that in the experimental example 1 (comparative example 1), thereby roughening a surface as an experimental example 2 (comparative example 2). Surface conditions of this developing sleeve were Rz=10 $\mu$m and Sm=32 $\mu$m which was at a degree on the order of Sm obtained with particles having a weight-average particle diameter of 40 $\mu$m. A durability test of this developing sleeve lowered a contamination level as shown in Table 1.

As a result of detailed examination of kinds of carriers and the like, it was found that an average peak-to-peak spacing Sm within a range of $D/3 \leqq Sm \leqq 6*D$, preferably within a range of $D/2 \leqq Sm \leqq 3*D$ is satisfactory taking a weight-average particle diameter of a carrier as D. When the average peak-to-peak spacing Sm is D/3 or larger, even a toner which has penetrated into valleys in a sleeve surface adheres to a carrier and is conveyed since the carrier is brought into contact with the toner at a circulating process of the carrier, whereby the toner does not stay on the sleeve surface and a contamination level can be lowered. When the average peak-to-peak spacing Sm exceeds 6*D, however, a developer conveying property of a developing sleeve degraded.

Figure 5:
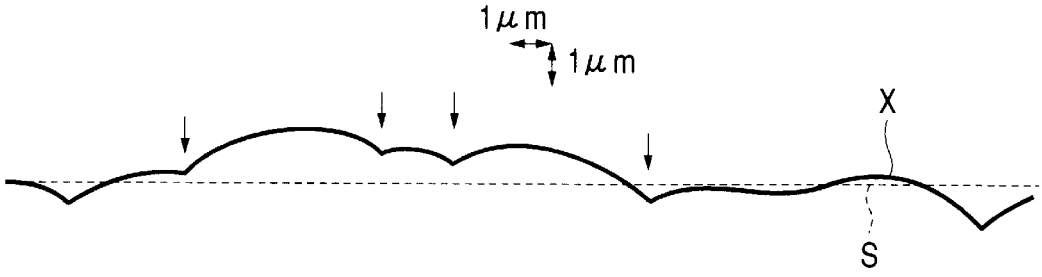
FIG. 5 is an enlarged view of a surface of a developing sleeve in example 2 for description of a peak-to-peak spacing.

A contamination level is lowered by adjusting the average peak-to-peak spacing Sm. When qualities of images formed by the developing sleeve, however, the developing sleeve is still apt to produce improper images and it is necessary to further lower the contamination level. A cause for defective images was considered as described below. FIG. 5 shows a profile of the surface of the developing sleeve used in the experimental example 2 which was measured in the detail conditions.

Unlike the experimental example 1, the experimental example permits confirming peaks and valleys. However, there exist on a curve forming the peaks and valleys concavities (indicated by ↓ in FIG. 5) which has curvature remarkably different from curvature of the curve, are 1 $\mu$m wide by 0.2 $\mu$m or deeper in a number of about 10 within a spacing of 100 $\mu$m. In this case also, the carrier cannot penetrate into the above described concavities even though the toner penetrates into the fine concavities. As a result, it is considered that the toner has not occasion to be brought into contact with the carrier at a circulating process of the carrier, adheres in a condition caught in the concavities and a caught portion and is fused during long use.

An experiment was therefore effected as described below.

Figure 6:
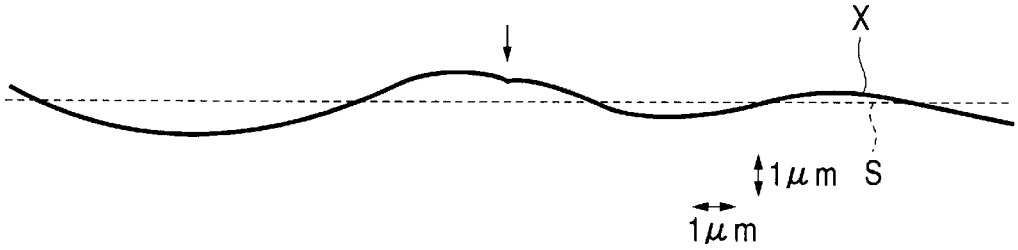
FIG. 6 is an enlarged view of a surface of a developing sleeve in example 3 for description of a peak-to-peak spacing.

As an experimental example 3, examinations were made using a developing sleeve made of aluminium and having a surface which was roughened to Rz=8.5 $\mu$m and an average peak-to-peak spacing Sm=34 $\mu$m using spherical glass beads having a weight-average particle diameter of 70 $\mu$m (FGB#300). As a result, a contamination level of this developing sleeve as reduced from that of the experimental example 2 (comparative example 2) after long use for developing images on 10000 sheets though the developing sleeve has an average peak-to-peak spacing Sm which was equal to that of the developing sleeve in the experimental example 2 (comparative example 2) as shown in Table 1. FIG. 6 shows a profile of the developing sleeve used in the experimental example 3.

Comparing surface shapes of the developing sleeves in the experimental example 1 (comparative example 1) and experimental example 2 (comparative example 2) which were blasted using the ARD with a surface shape of the developing sleeve in the experimental example 3 which was blasted with the FGB#300, the developing sleeve blasted using the FRB#300 (weight-average particle diameter 70 $\mu$m) in the third experimental example had, on a curve forming peaks and valleys, nearly no concavity which had curvature largely different from that of the above described curve and was 1 $\mu$m wide by 0.2 $\mu$m or deeper (indicated by ↓ in FIG. 6) and about 3 or 4 concavities existed within a spacing of 100 $\mu$m and had remarkably shallow depths. It is considered that even a toner having a small particle diameter penetrates nearly no locations and finds no core of fusion as a result, whereby contamination is reduced.

Figure 7:
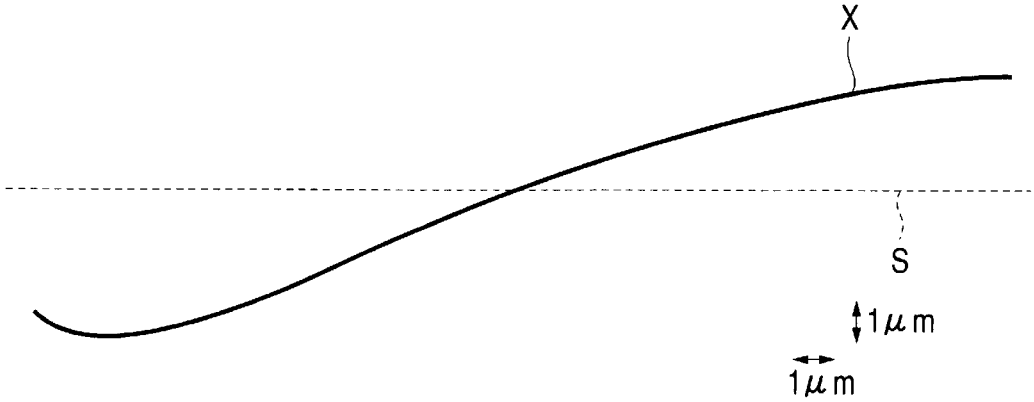
FIG. 7 is an enlarged view of a surface of a developing sleeve in example 4 for description of a peak-to-peak spacing.

As an experimental example 4, a surface of a developing sleeve made of aluminium was roughened using spherical glass beads which had a weight-average particle diameter of 180 $\mu$m (FGB#100) to an average roughness at ten points Rz=14 $\mu$m and an average peak-to-peak spacing Sm=60 $\mu$m. A surface profile of this developing sleeve exhibited, on a curve forming peaks and valleys, about two concavities in 100 $\mu$m spacing which had curvature largely different from that of the above described curve and were 2 $\mu$m wide by 0.2 $\mu$m or deeper as shown in FIG. 7. Examinations effected using this developing sleeve provided a result that a developer conveying property was enhanced, and a developer layer thickness was more stable and uniform on the developing sleeve as shown in Table 1 though a contamination level of the developing sleeve was substantially the same as that in the above described experimental example 3 after long use for development on 10000 sheets.

Table 1

TABLE 1

| | Experimental example 1 (comparative example) | Experimental example 2 (comparative example) | Experimental example 3 | Experimental example 4 |
|---|---|---|---|---|
| Material of developing sleeve | SUS | Aluminium | Aluminium | Aluminium |
| Kind of developing sleeve treatment | ARD#400 | ARD#150 | FGB#300 | FGB#100 |
| Average peak-to-peak spacing Sm | 13 $\mu$m | 32 $\mu$m | 33 $\mu$m | 60 $\mu$m |
| Average roughness at ten points Rz | 3 $\mu$m | 10 $\mu$m | 8.5 $\mu$m | 14 $\mu$m |
| Number of concavities | 30 | 10 | 3 to 4 | 2 |
| Contamination density ΔD | 0.33 | 0.15 | 0.05 | 0.05 |
| Image level | C | C | A | A |

A: Good
B: Ordinary
C: Bad

It was found that a conveying property can be enhanced while maintaining a smooth sleeve surface by enlarging the average roughness Rz at ten points in the experimental example 4 effected last. Though it is generally considered that enlargement of a value of the average roughness at ten points Rz allows a toner to be easily caught in concavities on a surface and enhances a contamination level of a developing sleeve, it is possible to prevent a contamination level of a developing sleeve from being enhanced even at a value of the average roughness at ten points Rz which is large at a certain degree by keeping, on a curve forming peaks and valleys, a number of concavities which have curvature largely different from that of the above described curve and are 1 μm to 10 μm wide and 0.2 μm or more deep small so as to be smaller than 10 in a spacing of 100 μm.

As a result of further detailed examinations of kinds of carriers and the like, it was found that contamination of a developing sleeve was reduced when average roughness at ten points Rz was set at ½ to 1/10 times of the weight-average particle diameter D. When Rz is set at D/10 or larger, the magnetic carrier is caught in valleys on a surface, thereby providing a result of an enhanced developer conveying property. When Rz is larger than ½*D, however, concavities and convexities on a sleeve surface are clearly recognized by eyes, and a developer layer is ununiform under an influence due to the concavities and convexities, thereby producing influences on an image.

Although a description has been made above of examples where the surfaces of the developing sleeves are blasted using the indefinite alumina particles (ARD) and spherical glass beads (FGB) as the abrasive grains after cutting original pipes, the surfaces which are blasted after cutting are in conditions where th surfaces have fine zigzags under an influence due to surface roughening at a cutting time. When such zigzags exist, toner particles having smaller particles which are contained in a toner get fast and adhere in and to fine grooves, thereby being fused and contaminating a sleeve.

As a method to solve such a problems, it is proposed to polish an original sleeve pipe with diamond after cutting and then roughen a surface by blasting. This method prevents sleeve contamination due to the surface roughening caused at a cutting time. The polishing with diamond almost eliminates the zigzags formed at the cutting time and improves a surface of the original pipe into a condition like a mirror surface free from microscopic zigzags.

The first embodiment, in which the average peak-to-peak spacing Sm is set at ⅓ to 6 times of the weight-average particles diameter D of the magnetic carrier contained in the two-component developer ($D/3 \leqq Sm \leqq 6*D$), the average roughness at ten points Rz is set at 1/10 to ½ times of the weight-average particle diameter D and, on the curves forming the peaks and valleys, a number of the concavities which have curvature largely different from that of the above described curve and are 1 μm to 10 μm wide and 0.2 μm or more deep is smaller than 10 within the spacing of 100 μm, makes it possible to prevent a toner from being embedded by a carrier into concavities of a surface of a developing sleeve, avoid contamination of the developing sleeve by fused toner and obtain good quality images stably for a long time.

Next a description will be made of methods to measure weight-average particle diameters of a carrier and a toner. In the present invention, a weight-average particle diameter of a carrier is measured by a method described below.

1. About 100 g of sample is measured up to the place of 0.1 g.
2. Standard sieves of 100 mesh to 400 mesh (hereinafter referred to simply as "sieves") are selected and overlapped in an order of 100 mesh (particle size 149 μm), 145 mesh (particle size 105 μm), 200 mesh (particle size 74 μm), 250 mesh (particle size 63 μm), 350 mesh (particle size 44 μm), and 400 mesh (particle size 37 μm), a drip pan is laid at a bottom, and the sample is placed on an uppermost sieve and the sieve is covered.
3. The sample is sifted with a vibrating machine at a horizontal rotating frequency of 285±6 per minute and at a vibrating frequency of 150±10 per minute for 15 minutes.
4. After sifting, iron powder in the sieves and the drip pan is weighed to a place of 0.1 g.
5. A value of a particle size distribution is calculated to a second decimal place and rounded to a first decimal place according to JIS-Z8401.

It is specified that a sieve frame has a size of an inside diameter of 200 mm above a sieve surface by a depth of 45 mm as measured from a top surface to the sieve surface and a total sum of a sample in each part must not be 99% or less of a weight of a sample initially measured.

From the above described calculated value of the particle size distribution, a wight-average particle diameter is determined by the following equation.

Weight-average particle diameter (μm)=1/100

{(amount remaining on the sieve of 100 mesh)×140

+(amount remaining on the sieve of 145 mesh)×122

+(amount remaining on the sieve of 200 mesh)×90

+(amount remaining on the sieve of 250 mesh)×68

+(amount remaining on the sieve of 350 mesh)×52

+(amount remaining on the sieve of 400 mesh)×38

+(amount having passed all the sieves)×14}

In the present invention, a weight-average particle diameter of a toner is measured by a method which is described below.

Using sodium chloride of class 1 as an electrolyte, a 1% NaCl aqueous solution is prepared with Coulter Counter-TA-II Type (manufactured by Coulter) or Coulter Multisizer (manufactured by Coulter) used as a measuring instrument connected to an interface (manufactured by Nikkaki) which outputs a number-average distribution and a volume-average distribution as well as CX-i Personal Computer (manufactured by Canon).

For measuring a weight-average particle diameter, 0.1 to 5 ml of surface active agent (preferably alkyl benzene sulfonate) is added as a dispersant to 100 to 150 ml of the above described electrolytic aqueous solution and 0.5 to 50 mg of sample to be measured is further added.

The electrolyte in which the sample is suspended is treated with an ultrasonic dispersing machine for one to three minutes, and a particle distribution of particles of 2 to 40 μm is measured using a 100 μm aperture and calculated, thereby obtaining a weight-average particle diameter of the sample.

Second Embodiment

A second embodiment is characterized in that the surface of the developing sleeve 3 is roughened as in the first embodiment and then the surface of the developing sleeve is reformed by coating the surface with Ni—P plating or Ni—B plating or Cr plating.

An effect to facilitate to control surface roughness and an effect to enhance abrasion resistance of the developing sleeve 3 are obtained by coating the surface of the developing sleeve 3 with Ni—P, Ni—B or Cr plating. Furthermore, such coating also provide an effect to smoothen the fine zigzags which are formed at the sleeve cutting time as described in the first embodiment.

Aluminium which is selected as a material of the developing sleeve 3 makes it possible to manufacture a developing sleeve at a lower cost than stainless steel, but a surface of the developing sleeve 3 made of aluminium has low hardness, abrasion resistance and a service life of the developing sleeve 3 is shortened when a two-component developer containing a carrier is used. By coating the surface with the Ni—P, Ni—B or Cr plating, it is possible to enhance the hardness of the aluminium surface, thereby prolonging the service life of the developing sleeve 3.

An enhancement of the abrasion resistance of the surface of the developing sleeve 3, a heater is built in an a-Si (amorphous silicon) drum for preventing an image quality flow phenomenon at an initial start time when the a-Si drum is used as a photosensitive drum for a high-speed apparatus. When the developing sleeve 3 is made of stainless steel which has a low heat conductivity, the developing sleeve 3 tends to be deformed by heat from the drum heater. Though it is sufficient to use aluminum having a high heat conductivity for preventing the developing sleeve 3 from being deformed by the heat from the drum heater, aluminum has abrasion resistance lower than that of the stainless steel. It is possible to harden the surface of the developing sleeve 3 and enhance abrasion resistance easily by coating the surface of the developing sleeve 3 with the Ni—P, Ni—B or Cr plating.

Third Embodiment

A third embodiment obtains a desired surface condition by roughening a surface of a developing sleeve and then coating the surface like the second embodiment, but is different in that the surface is coated with crystalline graphite and a resin layer containing electrically conductive carbon in the third embodiment. The coating of the resin layer facilitates to form the surface in a desired shape and hardens the developing sleeve like the Ni—P, Ni—B or Cr plating used in the second embodiment.

As described above, the present invention prevents a toner from being embedded by a carrier into concavities on a surface of a developing sleeve and hinders fused toner from contaminating the sleeve, thereby making is possible to obtain good quality image stably for a long time by setting an average peak-to-peak spacing (Sm) of convexities and concavities on a surface of an image bearing member of a developing apparatus at ⅓ to 6 times of a weight-average particle diameter (D) ($D/3 \leqq Sm \leqq 6*D$) of a magnetic carrier in a two-component developer, setting average roughness (Rz) at ten points on the surface at 1/10 to ½ times of the weight-average particle diameter (D) of the magnetic carrier and reducing, on a curve forming peaks and valleys in a surface profile, concavities which have curvature largely different from that of the above described curve and are 1 μm to 10 μm wide and 0.2 μm or more deep to a number smaller than 10 within a spacing of 100 μM.

Furthermore, the present invention makes it possible not only to effectively enhance abrasion resistance of a surface of a developing sleeve but also to facilitate to control the surface of the developing sleeve by coating the surface with Ni—P plating, Ni—B plating, Cr plating, crystalline graphite or a resin layer containing electrically conductive carbon.

What is claimed is:

1. A developing apparatus for an image forming apparatus includes means for forming an electrostatic latent image corresponding to an image information signal on an image bearing member, said developing apparatus comprising:

a developer carrying member which bears and conveys a two-component developer containing a non-magnetic toner and a magnetic carrier for forming a toner image by developing the electrostatic latent image formed on the image bearing member, wherein convexities and concavities are formed on a surface of said developer carrying member, and an average peak-to-peak spacing (Sm) of the convexities and concavities is set at ⅓ to 6 times a weight-average particle diameter of the magnetic carrier (D) ($D/3 \leqq Sm \leqq 6*D$), wherein an average roughness at ten points (Rz) on the surface of said developer carrying member is set at 1/10 to ½ times the weight-average particle diameter of the magnetic carrier, wherein a number of concavities which are 1 μm to 10 μm wide and 0.2 μm or more deep is smaller than 10 within a spacing of 100 μm in a surface profile of said developer carrying member, and wherein the surface of said developer carrying member is a blasted surface prepared by blasting the surface of said developer carrying member with definite spherical particles having a weight-average diameter d and a weight-average particle diameter D of the magnetic carrier, according to the following relation:

$$D \leqq d \leqq 10D.$$

2. The developing apparatus according to claim 1, wherein the surface of said developer carrying member is made of aluminum, and the convexities and concavities on the surface of said developer carrying member are formed by a blast treatment using spherical glass beads.

3. The developing apparatus according to claim 1, wherein the convexities and concavities are formed by roughening the surface of said developer carrying member and the average peak-to-peak spacing (Sm) and the average roughness (Rz) at ten points on the surface of said developer carrying member are adjusted by coating the blasted surface.

4. The developing apparatus according to claim 1, wherein said developer carrying member includes a plated layer formed on the surface of said developer carrying member, said plated layer including a material selected from a group consisting essentially of: Ni—P, Ni—B, and Cr.

5. The developing apparatus according to claim 1, wherein said developer carrying member is made of a material selected from a group consisting essentially of: stainless steel and aluminum.

6. The developing apparatus according to claim 1, wherein magnetic field producing means is disposed in said developer carrying member, and said magnetic field producing means includes a first magnetic pole, which is disposed downstream of a developing area in a developer conveying direction, and a second magnetic pole, which is disposed downstream of said first magnetic pole and has a polarity identical to a polarity of said first magnetic pole.

7. The developing apparatus according to claim 6, wherein said magnetic field producing means includes a repulsive pole, which is provided between and substantially cancels magnetic forces generated by said first magnetic pole and said second magnetic pole.

8. The developing apparatus according to claim 1, wherein electric field producing means is disposed so as to an alternating electric field between said image bearing member and said developer carrying member.

9. The developing apparatus according to claim 1, wherein the average roughness Rz at ten points on the surface of said developer carrying member and the weight-average particle diameter D of said magnetic carrier satisfies the following relation:

$$D/6 \leqq Rz \leqq D/2.$$

10. The developing apparatus according to claim 9, wherein the surface of said developer carrying member is polished with a diamond material and then blasted with definite spherical particles.

11. The developing apparatus according to claim 9, wherein the surface of said developer carrying member is blasted with definite spherical particles and then subjected to electroless plating.

12. The developing apparatus according to claim 11, wherein said electroless plating is a plating selected from the group consisting essentially of: an electroless Ni—P plating, an electroless Ni—B plating, an electroless Pd—P plating, and an electroless Cr plating.

13. The developing apparatus according to claim 9, wherein said developer carrying member is a material selected from a group consisting essentially of: of stainless steel and aluminum.

14. The developing apparatus according to claim 1, wherein said definite spherical particles are particles selected from a group consisting essentially of: glass beads, stainless steel balls, and ceramic balls.

15. The developing apparatus according to claim 1, wherein the non-magnetic toner has a weight-average particle diameter of 5 $\mu$m to 9 $\mu$m and the magnetic carrier has a weight-average particle diameter of 20 $\mu$m to 60 $\mu$m.

* * * * *

UNITED STATES PATENT AND TRADEMARK OFFICE

CERTIFICATE OF CORRECTION

PATENT NO. : 6,546,222 B2
DATED : April 8, 2003
INVENTOR(S) : Yuji Sakemi et al.

It is certified that error appears in the above-identified patent and that said Letters Patent is hereby corrected as shown below:

Column 1,
Line 36, “aluminium” should read -- aluminum --.

Column 3,
Lines 14, 16 and 21, “above” should read -- above- --.

Column 5,
Line 62, “becomes” should read -- become --.

Column 8,
Line 53, “dependently” should read -- depending --.

Column 14,
Line 53, “inventor et al.” should read -- inventors --.

Column 15,
Line 10, “inventor et al.” should read -- inventors --.

Column 17,
Line 28, “th” should read -- the --.
Line 34, “a” shoud be deleted;
Line 61, “0.1” should read -- 0.1 g. --; and
Line 62, “g.” should be deleted.

Column 20,
Line 65, “to” should read -- to form --.

UNITED STATES PATENT AND TRADEMARK OFFICE

CERTIFICATE OF CORRECTION

PATENT NO. : 6,546,222 B2

DATED : April 8, 2003

It is certified that error appears in the above-identified patent and that said Letters Patent is hereby corrected as shown below:

Column 22,
Line 6, "of" (second occurrence) should be deleted.

Signed and Sealed this

Eighteenth Day of November, 2003

JAMES E. ROGAN
*Director of the United States Patent and Trademark Office*